United States Patent [19]

Butzen

[11] Patent Number: 5,022,289

[45] Date of Patent: Jun. 11, 1991

[54] RATCHET TOOL WITH FLATTENED POCKET

[75] Inventor: James K. Butzen, Grayslake, Ill.

[73] Assignee: Snap-on Tools Corporation, Kenosha, Wis.

[21] Appl. No.: 568,234

[22] Filed: Aug. 16, 1990

[51] Int. Cl.[5] ..... B25B 13/46

[52] U.S. Cl. ..... 81/57.39; 81/57.13

[58] Field of Search ..... 81/57.13, 57.39, 57.29

[56] References Cited

U.S. PATENT DOCUMENTS

| | | | |
|---|---|---|---|
| 3,529,498 | 9/1970 | Northcutt | 81/54 |
| 3,621,738 | 11/1971 | Northcutt | 81/57.39 |
| 4,346,630 | 8/1982 | Hanson | 81/57.13 |
| 4,722,252 | 2/1988 | Fulcher et al. | 81/57.39 |
| 4,766,784 | 8/1988 | Lai | 81/57.39 |
| 4,821,611 | 4/1989 | Izumisawa | 81/57.29 X |

*Primary Examiner*—James G. Smith

*Attorney, Agent, or Firm*—Emrich & Dithmar

[57] ABSTRACT

The ratchet tool comprises an elongated housing and a drive body carried by the housing and being rotated by a ratchet ring the toothed opening of which is in engagement with a pawl carried by the drive body. A pocket in the ring has semi-cylindrical side surfaces which engage mating semi-cylindrical surfaces of the pocket. The front of the pocket is flat, thereby increasing the thickness of the region between the pocket and the toothed opening. With increased thickness, the stress in such region is reduced and the ring is less likely to crack during use.

6 Claims, 2 Drawing Sheets

RATCHET TOOL WITH FLATTENED POCKET

BACKGROUND OF THE INVENTION

An air-powered ratchet tools includes an elongated housing and a rotatable drive body which accommodate a socket for loosening and tightening fasteners. The ratchet tool includes an air motor which operates through a transmission to oscillate a ratchet ring. The toothed main opening in the ring engages a pawl which is pinned to the drive body to rotate same.

The connection between the transmission and the ring is in the form of a bar located in a pocket of the ring. In current ratchet tools in the marketplace, the cross section of the pocket is substantially circular. Its front end is spaced rearwardly of the toothed opening. This region of the ring between the opening and the pocket is highly stressed and is subject to cracking.

SUMMARY OF THE INVENTION

It is, therefore, an important object of the present invention to provide a ratchet tool having a ratchet ring which is so constructed as to be less susceptible to cracking during use.

In summary, there is provided a ratchet tool comprising an elongated housing, a drive body carried by the housing, a ratchet ring including a toothed surface and a pocket, pawl means on the drive body and including a toothed surface engaging the toothed surface of the ring, the pocket having front and rear ends and substantially semi-cylindrical side surfaces, the pocket having a mouth at the rear end and a substantially planar wall at the front end, a bar in the pocket and including substantially semi-cylindrical side surfaces respectively mating with the semi-cylindrical side surfaces of the pocket, and drive means mounted in the housing and having an eccentric pin in operative engagement with the bar.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
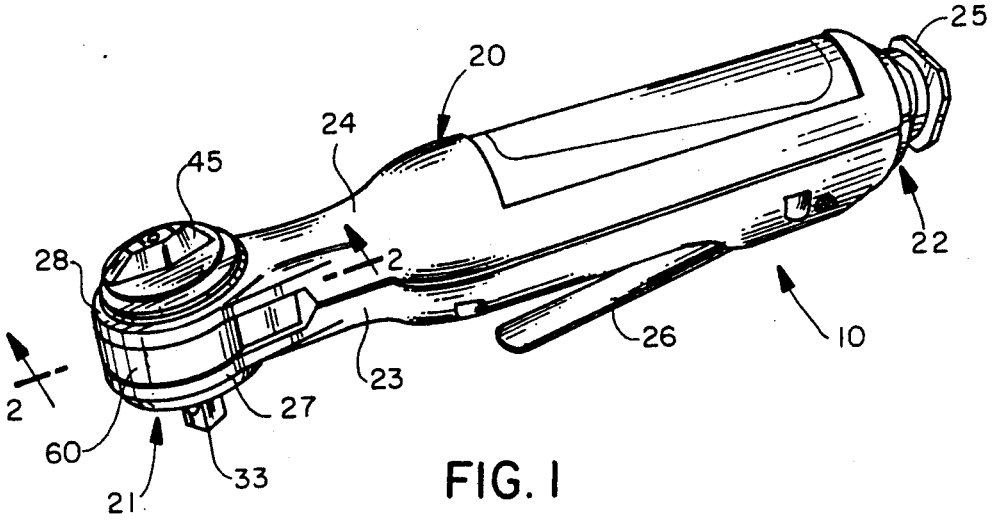
FIG. 1 is a perspective view of a ratchet tool constructed in accordance with the features of the present invention.

Turning now to the drawings, and more particularly to FIG. 1 thereof, there is depicted a ratchet tool 10 constructed in accordance with the present invention. Ratchet tool 10 comprises an elongated housing 20 including a front end 21 and a rear end 22. Housing 20 includes a semi-cylindrical base 23 and a substantially semi-cylindrical cover 24. A fitting 25 located at rear end 22 is adapted for connection to a source of air. The air-driven motor (not shown) is mounted in housing 20. A paddle 26 is pivotally mounted to base member 23 and is spring loaded to its off position. When depressed to its on position by the operator, air is delivered to the air motor to cause its shaft (not shown) to rotate. Housing 20 includes a fork at front end 21 defined by arms 27 and 28. A knob 45 allows selection of the tightening and loosening conditions of the ratchet tool.

Figure 2:
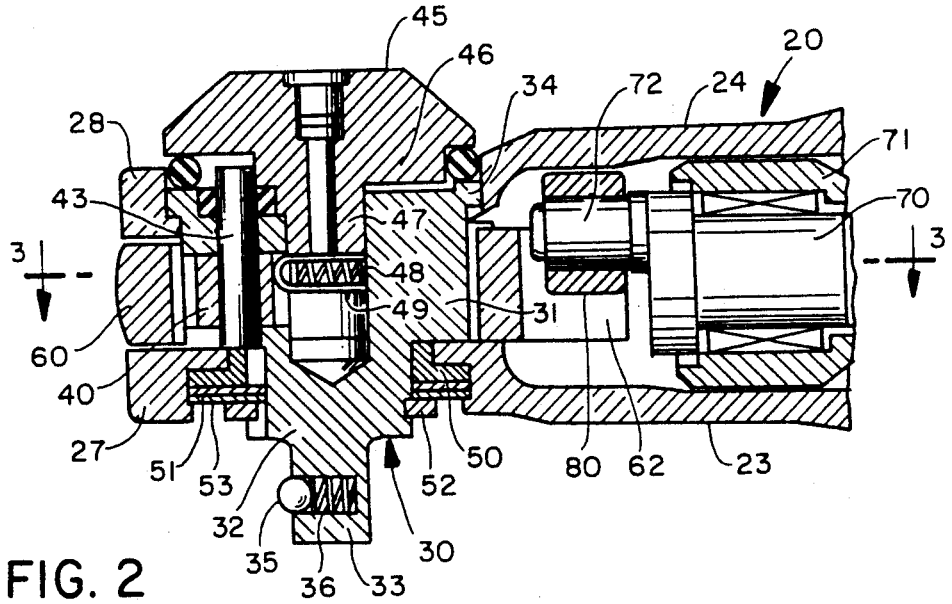
FIG. 2 is a cross-sectional view, on an enlarged scale, taken along the line 2—2 of FIG. 1.
Figure 3:
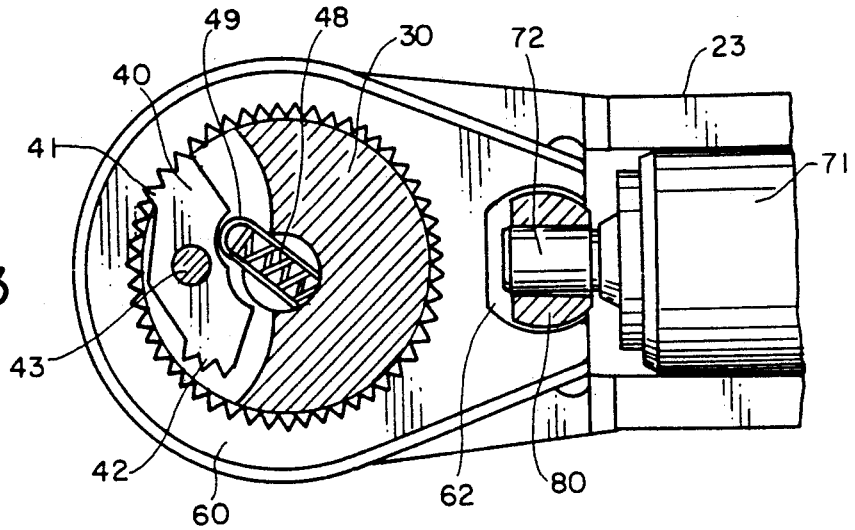
FIG. 3 is a cross-sectional view, taken along the line 3—3 of FIG. 2.

Referring to FIGS. 2 and 3, the ratchet tool 10 further comprises a drive body 30 including a central portion 31, a head 32 extending from portion 31 and a square stud 33 extending from head 32. A shoulder 34 is at one end of portion 31. A ball 35 biased by a spring 36 is used to removably retain a selected socket on stud 33.

Tool 10 further comprises a pawl 40 including toothed ends 41 and 42. Pawl 40 is located in an arcuate slot of portion 31 of drive body 30. A pin 43 is in a bore of portion 31 and mounts pawl 40 for rotation within such slot.

Ratchet 10 also comprises a knob 45 which includes a part-cylindrical projection 46 and a shaft 47 depending from such projection. Knob 45 is positioned above drive body 30 and shaft 47 is disposed within a bore that extends centrally into drive body 30. A spring 48 and a plunger 49 are located in a transverse bore of shaft 47. Plunger 49 abuts pawl 40.

Shoulder 34 is disposed against arm 28. Ratchet 10 further comprises a bushing 50 having a sleeve-like portion and a flange-like portion. Bushing 50 is press fit into the opening in arm 27. A washer 51 is disposed against the flange-like portion of bushing 50 and surrounds drive body 30. A retaining ring 52 is located within a groove in drive body 30. A disc spring 53 is disposed between washer 51 and ring 52. Thus, drive body 30 is securely held in arms 27 and 28.

Ratchet tool 10 further comprises a ratchet ring 60, which is somewhat pear shaped, having a large, toothed cylindrical opening 61 (FIG. 4) and a pocket 62 rearwardly of opening 61. Ratchet ring 60 is disposed between arms 27 and 28 and surrounds drive body 30.

Tool 10 further comprises a motor (not shown) mounted generally in the middle of housing 20. Its shaft (not shown) is coupled via a gear reducer mechanism (not shown) which in turn drives a crank shaft 70 rotatably mounted within a bearing block 71, such crank shaft including an eccentrically mounted pin 72. When the air motor operates, the pin 72 is caused to orbit about the longitudinal axis of tool 10. Pin 72 carries a bar 80, which is located in pocket 62 of ring 60.

During one-half a revolution of crank shaft 70, bar 80 causes ring 60 to rotate in one direction. For the balance of each revolution, bar 80 causes ring 60 to rotate in the opposite direction. When knob 45 is in its fastener tightening position, plunger 49 engages pawl 40 near one toothed end to cause the same to engage toothed cylindrical opening 61. In this condition, tool 10 can be used to rotate a fastener in a clockwise direction and to ratchet in a counterclockwise direction. When knob 45 is rotated to its fastener loosening position, plunger 49 engages pawl 40 near the other toothed end, to cause same to engage opening 61. In this condition, tool 10 can be used to rotate the fastener in a counterclockwise direction and to ratchet in the clockwise direction.

Figure 4:
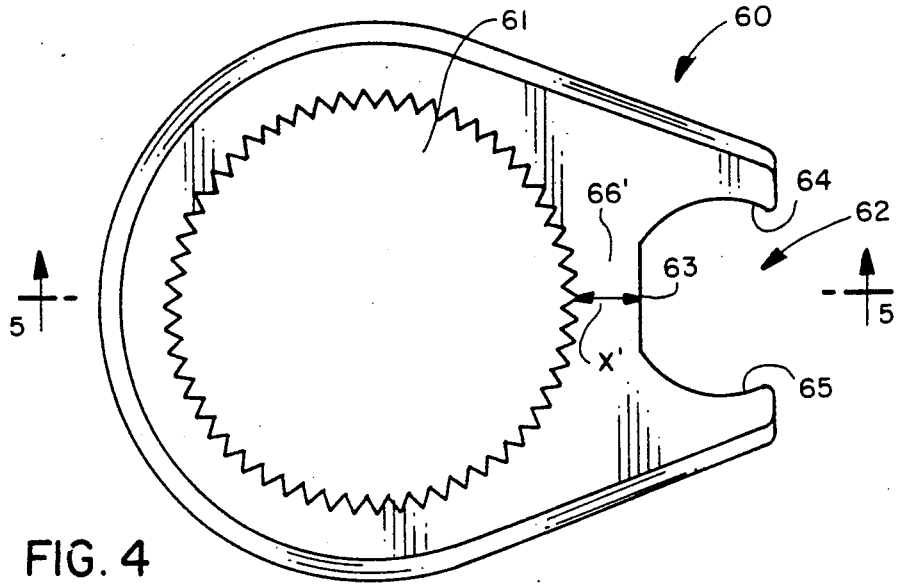
FIG. 4 is a plan view of the ratchet ring on a further enlarged scale.
Figure 5:
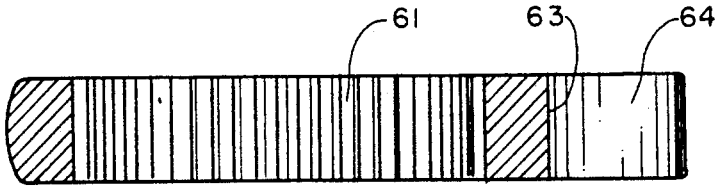
FIG. 5 is a cross-sectional view taken along the line 5—5 of FIG. 4.

Further details of the ring 60 are depicted in FIGS. 4 and 5. As previously explained, ring 60 has a large, generally cylindrical opening the surface of which is toothed. The front of pocket 62 is a substantially planar surface 63 and the rear of such pocket defines a mouth. The side surfaces 64 of pocket 62 are substantially semi-cylindrical.

Figure 6:
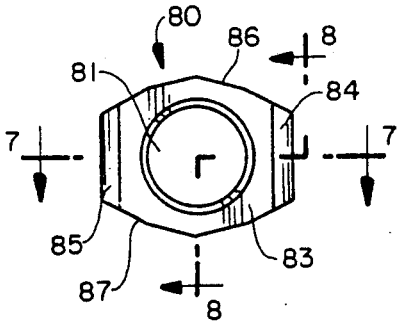
FIG. 6 is an elevational view of the driving bar.
Figure 7:
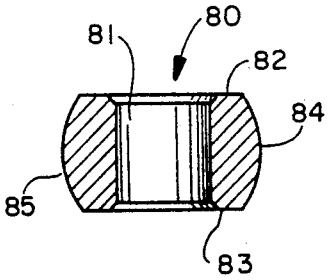
FIG. 7 is a cross-sectional view taken along the line 7—7 of FIG. 6.
Figure 8:
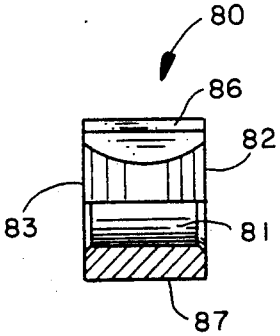
FIG. 8 is a cross-sectional view taken along the line 8—8 of FIG. 6.

Further details of bar 80 are depicted in FIGS. 6–8. Bar 80 includes a central bore 81 which receives pin 72 (FIGS. 2,3). Bar 80 has substantially planar front and rear surfaces 82 and 83, respectively, these surfaces being substantially parallel and perpendicular to the axis of rotation. Bar 80 has substantially semi-cylindrical side surfaces 84 and 85 respectively. The front surface 82 is spaced rearwardly from surface 63.

Finally, the top and bottom surfaces of bar 80 each consist of four planar facets in the particular embodiment depicted.

Figure 9:
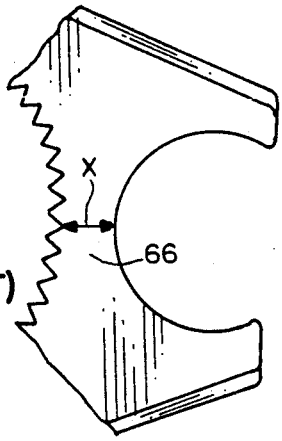
FIG. 9 (PRIOR ART)

By incorporating a pocket having a planar surface 63 and a bar with a flat front surface 82 improved strength in the ring 60 is achieved. In the past, the pocket 62 was semi-circular as depicted in FIG. 9. The front surface was a circular continuation of the side surfaces. As a result, the thickness of the region 66 between the toothed opening and the pocket had a length X, which was relatively short. Tensile stress in the region 66 is inversely proportional to the length X and, therefore, the ring was subject to cracking. However, by flattening the front of pocket 62, the thickness X′ of region 66′ (in FIG. 4) increased by about 30% in the embodiment depicted, thereby causing the ring to be about 30% stronger. In a particular form of the invention, the surface 63 is spaced rearwardly from the opening 61 about $\frac{1}{8}''$.

What has been described therefor is an improved ratchet ring for a ratchet tool, which has less tendency to crack during use.

What is claimed is:

1. A ratchet tool comprising an elongated housing, a drive body carried by said housing, a ratchet ring including a toothed surface and a pocket, pawl means on said body and including a toothed surface engaging the toothed surface of said ring, said pocket having front and rear ends and substantially semi-cylindrical side surfaces, said pocket having a mouth at said rear end and a substantially planar wall at said front end, a bar in said pocket and including substantially semi-cylindrical side surfaces respectively mating with the semi-cylindrical side surfaces of said pocket, and drive means mounted in said housing and having an eccentric pin in operative engagement with said bar.

2. The ratchet tool of claim 1, wherein said ratchet ring includes a substantially cylindrical opening located forwardly of said pocket, said toothed surface being located in said opening, said pawl means being located in said opening.

3. The ratchet tool of claim 1 wherein said bar includes substantially planar front and rear surfaces.

4. The ratchet tool of claim 1, wherein said bar has a cylindrical opening therethrough, the axis of said cylindrical opening being substantially parallel to the axis of said housing, said pin being located in said cylindrical opening to provide operative engagement between said drive means and said bar.

5. The ratchet tool of claim 3, wherein the front surface of said pocket and the front surface of said bar are substantially parallel and in spaced relationship.

6. The ratchet tool of claim 1, wherein the distance between the front surface of the pocket and the cylindrical opening is about $\frac{1}{8}''$.

* * * * *